US006241009B1

(12) United States Patent
Rush

(10) Patent No.: US 6,241,009 B1
(45) Date of Patent: Jun. 5, 2001

(54) INTEGRATED HEAT PIPE VENT CONDENSER

(75) Inventor: Gregory C. Rush, Plain Township, OH (US)

(73) Assignee: Hudson Products Corporation, Houston, TX (US)

( * ) Notice: Subject to any disclaimer, the term of this patent is extended or adjusted under 35 U.S.C. 154(b) by 0 days.

(21) Appl. No.: 09/498,842

(22) Filed: Feb. 7, 2000

(51) Int. Cl.[7] ..... F28B 9/10
(52) U.S. Cl. ..... 165/113; 165/111; 165/DIG. 222
(58) Field of Search ..... 165/110, 111, 165/112, 113, 114, DIG. 913, DIG. 222

(56) References Cited

U.S. PATENT DOCUMENTS 4,033,406 * 7/1977 Basiulis ..... 165/110
4,036,290 * 7/1977 Kelly ..... 165/110
4,149,588 * 4/1979 Waters ..... 165/110
4,226,282 10/1980 Kunsagi et al. .
4,379,485 * 4/1983 Fisher, Jr. et al. ..... 165/110
4,381,817 * 5/1983 Brigida et al. ..... 165/110
4,640,344 * 2/1987 Pravda ..... 165/111
4,928,753 * 5/1990 Kotaka ..... 165/113

* cited by examiner

*Primary Examiner*—Ira S. Lazarus
*Assistant Examiner*—Terrell McKinnon
(74) *Attorney, Agent, or Firm*—R. C. Baraona

(57) ABSTRACT

An integrated heat pipe vent condenser for a heat pipe steam condenser has a vent condenser casing surrounding one or more heat pipes in a vapor duct of the heat pipe steam condenser. The casing may be provided at an inclined orientation relative to a vertical axis of the heat pipe steam condenser. A plurality of baffles are positioned within the casing to provide a serpentine path for a vapor flow entering the casing from the vapor duct to pass through. Condensable gases from the vapor flow condense on the heat pipes and baffles and condensate is drained back into the vapor duct for removal through a drain or downcomer having a trap to prevent vapor flow from entering the downcomer.

18 Claims, 2 Drawing Sheets

INTEGRATED HEAT PIPE VENT CONDENSER

CROSS-REFERENCE TO RELATED APPLICATIONS

Ser. No. 08/610,567, filed Mar. 6, 1996, is drawn to STEAM CONDENSING APPARATUS and U.S. Pat. No. 5,766,320, issued Jun. 16, 1998, INTEGRAL DEAERATOR FOR A HEAT PIPE STEAM CONDENSER.

FIELD AND BACKGROUND OF THE INVENTION

The present invention relates generally to the field of industrial and utility power generation vapor condensers and, in particular, to a new and useful heat pipe vent condenser (HPVC) integrated into a heat pipe steam condenser for the condensation of steam and concurrent removal of unwanted, non-condensable gases.

Vent condensers are used to separate and drain the condensable portion of a multi-component vapor flow. Non-condensable gases are exhausted from the vent condenser. Vent condensers typically have a shell and tube or a U-tube heat exchanger with a coolant flow over the tube side to condense the condensable portion of the multi-component vapor flow.

A heat pipe steam condenser has several modules of heat pipes stacked in series to receive a flow of steam. As the working vapor, usually in the form of steam, moves through the modules, water vapor content in the gas space is reduced through condensation to water on the outside surfaces of the heat pipes at the evaporator ends thereof, while the concentration of non-condensable gases increases.

At one or more points within the heat pipe steam condenser, usually at the back-end of the last condenser module where the non-condensable gas fraction is greatest, the non-condensable gases are aspirated through a separate vent condenser. The gases are aspirated prior to exhausting these gases to a downstream eductor or other suitable device for maintaining the non-condensable gas flow through the vent condenser. The purpose of the vent condenser is to remove as much of the working vapor as possible from the vapor flow mixture that the operating temperature of the heat pipe will permit. This minimizes the energy and flow requirements of the eductor and minimizes the working vapor loss from the heat pipe steam condenser.

All known prior vent condensers have been installed externally to the heat pipe steam condenser. Such vent condensers normally use a coolant supply, such as cold water, to condense the working vapor on heat exchanger surfaces before exhausting non-condensable gas portions from the system.

SUMMARY OF THE INVENTION

It is an object of the present invention to provide an integrated condensable gas recovery system to eliminate connections and piping between vent condensers and heat pipe steam condensers. It is a further object of the invention to provide a heat pipe condenser system which does not require a separate coolant and is not subject to freezing.

Accordingly, an integrated heat pipe vent condenser for a heat pipe steam condenser is provided wherein the vent condenser is located within a heat pipe steam condenser module. The integrated vent condenser has a plurality of heat pipes with evaporator ends positioned within a vent condenser casing located in a vapor duct of the heat pipe steam condenser. The vapor flow through the steam duct enters the vent condenser casing and travels through the casing in a path defined by a plurality of baffles, releasing heat to the evaporator ends of the heat pipes and causing condensable gases to condense on the baffles and evaporator ends surfaces. Condensed gases are drained through a downcomer. Non-condensable gases are exhausted from the casing to an eductor, manifold, or other exhaust system for disposal.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
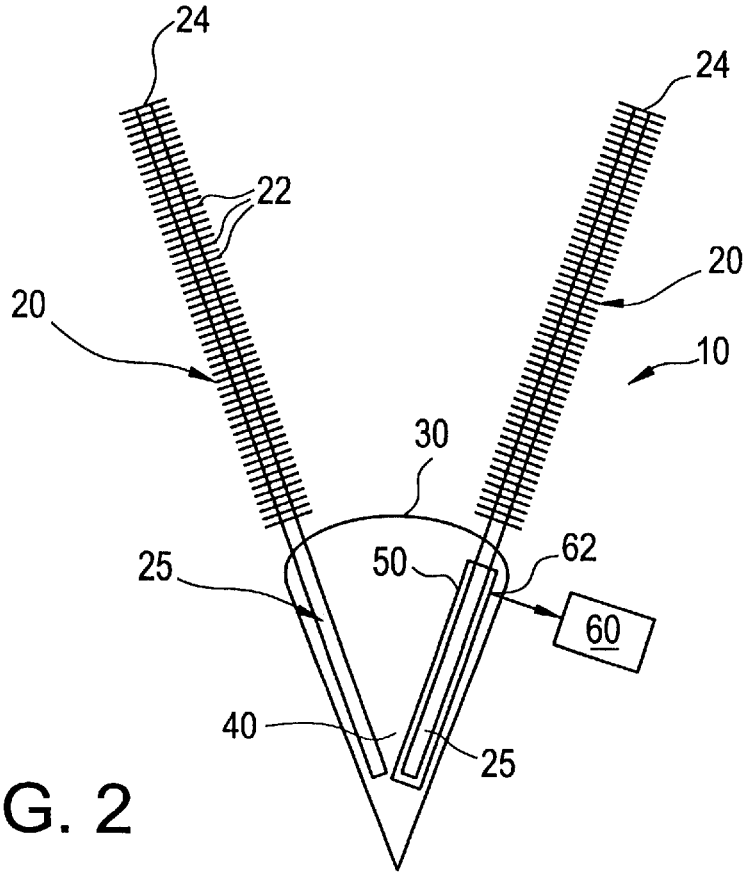
FIG. 1 is a side sectional elevational view of an integrated heat pipe vent condenser of the invention.

Referring now to the drawings, wherein like reference numerals refer to the same or functionally similar elements throughout the several drawings, FIG. 1 illustrates a heat pipe vent condenser (HPVC) generally referred to as 10. Heat pipes 20 are positioned through a steam duct 30 in the HPVC 10, which is part of a heat pipe steam condenser module 120, such as shown in FIG. 5.

Figure 5:
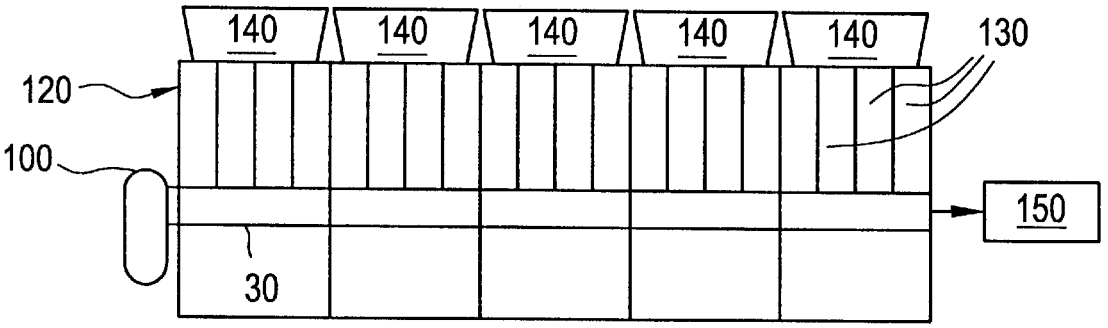
FIG. 5 is a schematic view of a heat pipe steam condenser according to the invention.

As seen in FIG. 5, a steam flow, generally shown by line S and containing condensable and non-condensable gases in a vapor mixture, is provided from steam header 100 through vapor duct 30 to a plurality of heat pipe steam condenser modules 120 arranged in series. Each heat pipe steam condenser module 120 is provided with a fan 140. Within the heat pipe steam condenser modules 120, a plurality of heat pipes 20 are arranged in bundles 130 in communication with the working vapor, usually steam, in vapor duct 30 for removing heat from the steam flow to cause condensable gases to condense on the heat pipe surfaces.

Returning to FIG. 1, evaporator ends 25 of heat pipes 20 extend through vapor duct 30. The upper ends of heat pipes 20 are condenser ends 24. A plurality of heat dissipation fins 22 are provided along the length of condenser ends 24.

Figure 2:
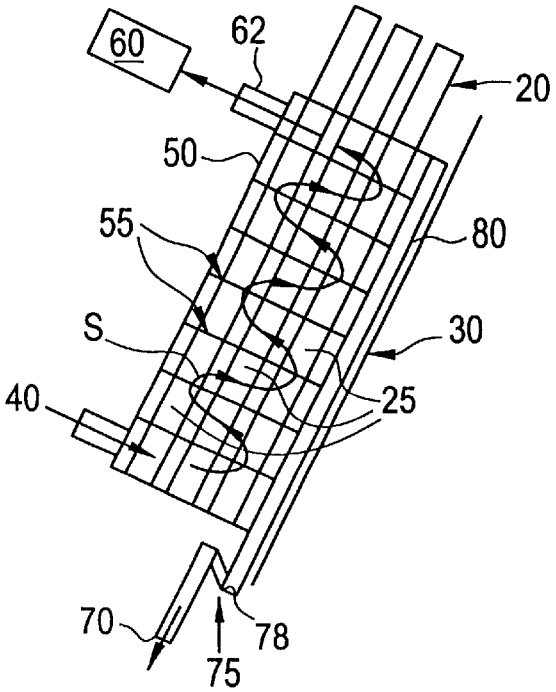
FIG. 2 is an enlarged side sectional elevational view of the lower end of the vent condenser of FIG. 1, taken along line A—A of FIG. 1.

Inside vapor duct 30, vent condenser casing 50 surrounds evaporator ends 25 of heat pipes 20. Vent condenser casing 50 has inlet 40 at a lower end and outlet 62 at an upper end. In FIG. 2, vapor flow S enters at inlet 40 and winds in a serpentine path upwards through horizontal baffles 55 positioned between evaporator ends 25. Vapor flow S rises through the baffles 55, giving off heat to evaporator ends 25 and causing additional condensable gases to condense on the surfaces of evaporator ends 25 and baffles 55. The vapor flow S exits the casing 50 through outlet 62, from where it is directed out of the system to either an eductor 60, a manifold, or other exhaust system for exhausting the non-condensable gases in a known manner.

A downcomer 80 is provided on casing 50 for draining condensed gases and vapors from vapor flow S. As seen in FIGS. 1 and 2, the casing 50 and heat pipes 20 are oriented obliquely to the horizontal, in an inclined position.

Figure 4:
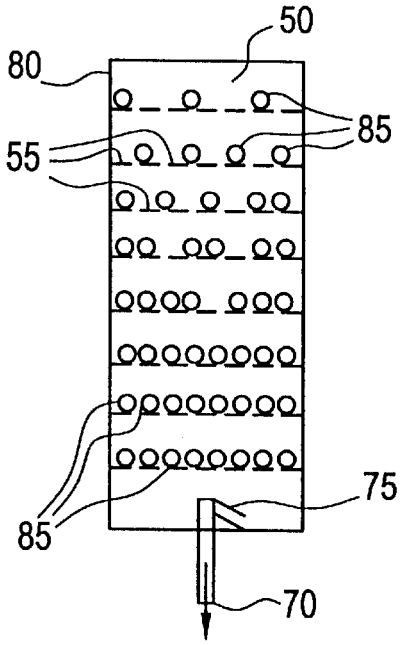
FIG. 4 is a rear elevational view of the vent condenser of FIG. 2, taken along line C—C of FIG. 2

FIG. 4 shows a plurality of drain openings 85 through the back wall of casing 50 into downcomer 80. The drain openings 85 are located at the same elevation as the lower end of the baffles 55 in casing 50. The drain openings 85 are designed to prevent the vapor flow S from traveling directly to downcomer 80 by reducing the opening to a size that allows only liquid to flow through and eliminates all other excess area of the opening. Accordingly, these openings help reduce re-entrainment of the condensate by removing the condensate immediately, thereby offering an improvement over the prior art.

The downcomer 80 drains through trap 75 to drain outlet 70 and back into vapor duct 30. Condensate which drains into vapor duct 30 is removed in manner conventional to heat pipe steam condensers. One or more weep holes 78 may be provided in trap 75 to allow condensate to drain directly from the trap in the event that a freezing condition occurs, although the present invention was designed specifically to avoid such conditions. Trap 75 otherwise prevents vapor flow from entering the vent condenser casing 50 through downcomer 80.

Figure 3:
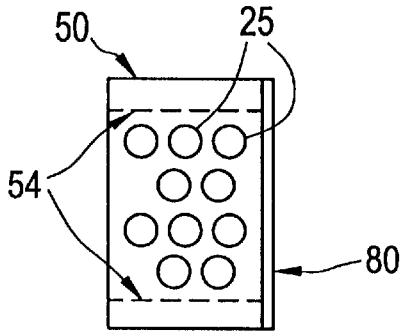
FIG. 3 is a top plan view of the vent condenser of FIG. 2, taken along line B—B of FIG. 2.

FIG. 3 shows a top plan view of the vent condenser. Baffle ends 54 are ideally situated so that all of the evaporator ends 25 intersect all of the baffles 55, thereby maximizing the heat exchange efficiency. An alternate baffle arrangement in which the baffles are vertically disposed, rather than inclined horizontally, is also possible. In such a vertical arrangement, drain openings may be provided adjacent to the bottom of casing 50 and/or adjacent to the baffle ends 54 to allow condensate to pass into downcomer 80.

While the casing 50 surrounding heat pipes 20 has been shown to be square or rectangular in the drawings, it is anticipated that other configurations, such as cylindrical, may be more economical to install and/or operate. Likewise, any arrangement of baffles 55 within vent condenser casing 50 is possible (i.e., diagonal, concentric, etc.). Further, the number of heat pipes 20 encased in the casing 50 may be varied according to the desired flow characteristics and space requirements of the system.

Several advantages are obtained from the integrated heat pipe vent condenser of the invention. In particular, it is believed that the freezing condition which can occur in other types of vent condensers is eliminated, since there is no liquid coolant which must be maintained above a freezing point. Further, the heat pipes used in the present invention are an efficient passive heat transfer mechanism, with no need for moving mechanical parts or a forced coolant circulation system. Consequently, chemical cleansers, coolant pumps, collection tanks, external piping, valves, and other equipment required by prior art vent condensers, as well as the maintenance and costs associated therewith, are eliminated.

While a specific embodiment of the invention has been shown and described in detail to illustrate the application of the principles of the invention, it will be understood that the invention may be embodied otherwise without departing from such principles.

I claim:

1. An integrated heat pipe vent condenser for use in a heat pipe steam condenser, the integrated heat pipe vent condenser comprising:

a vent condenser casing located within a vapor duct of the heat pipe steam condenser, the vent condenser casing having an inlet in communication with the interior of the vapor duct and an outlet;

at least one heat pipe extending through the vapor duct and into the vent condenser casing;

baffle means within the vent condenser casing for providing a serpentine path through the vent condenser casing; and drain means in communication with the vent condenser casing for providing a path to remove a condensate from the vent condenser casing.

2. The integrated heat pipe vent condenser according to claim 1, wherein the vent condenser casing and at least one heat pipe are oriented inclined relative to a vertical axis.

3. The integrated heat pipe vent condenser according to claim 2, wherein the baffle means comprises a plurality of horizontal spaced apart baffles oriented obliquely to a horizontal axis.

4. The integrated heat pipe vent condenser according to claim 3, wherein the plurality of baffles are inclined downwardly toward the drain means.

5. The integrated heat pipe vent condenser according to claim 4, wherein the drain means comprises a downcomer having a plurality of drain openings through the vent condenser casing, the drain openings positioned adjacent the plurality of baffles.

6. The integrated heat pipe vent condenser according to claim 2, wherein the baffle means comprises a plurality of spaced apart baffles, the baffles being oriented approximately parallel to the at least one heat pipe within the vent condenser casing.

7. The integrated heat pipe vent condenser according to claim 1, wherein the drain means comprises a downcomer having a plurality of drain openings through the vent condenser casing, a trap at the lower end of the downcomer, and a drain outlet at the side of the trap opposite the downcomer.

8. The integrated heat pipe vent condenser according to claim 1, wherein the at least one heat pipe comprises a plurality of heat pipes.

9. The integrated heat pipe vent condenser according to claim 1, wherein the outlet of the vent condenser casing is connected to an eductor.

10. A heat pipe steam condenser having an integrated heat pipe vent condenser, the heat pipe steam condenser comprising:

at least one heat pipe steam condenser module having a plurality of heat pipes therein arranged in bundles, each heat pipe having an evaporator end and a condenser end;

vapor duct means for encasing the evaporator ends of the plurality of heat pipes to provide an enclosed path for a vapor flow to the evaporator ends;

at least one integrated heat pipe vent condenser casing located within the vapor duct means and surrounding at least one of the plurality of evaporator ends, the integrated heat pipe vent condenser casing having an inlet in communication with the vapor duct means and an outlet;

baffle means within the at least one integrated heat pipe vent condenser casing for providing a serpentine path therethrough; and drain means in communication with the at least one integrated heat pipe vent condenser casing for draining condensate therefrom.

11. The heat pipe steam condenser according to claim 10, wherein the at least one heat pipe vent condenser casing and at least one of the plurality of heat pipes are oriented inclined relative to a vertical axis of the at least one heat pipe steam condenser module.

12. The heat pipe steam condenser according to claim 11 wherein the baffle means comprises a plurality of horizontal spaced apart baffles oriented obliquely to a horizontal axis of the at least one heat pipe steam condenser module.

13. The heat pipe steam condenser according to claim 12, wherein the plurality of baffles are inclined downwardly toward the drain means.

14. The heat pipe steam condenser according to claim 13, wherein the drain means comprises a downcomer having a plurality of drain openings through the at least one vent condenser casing, the drain openings positioned adjacent the plurality of baffles.

15. The heat pipe steam condenser according to claim 11, wherein the baffle means comprises a plurality of spaced apart baffles, the baffles being oriented approximately parallel to the at least one heat pipe encased by the at least one heat pipe vent condenser casing.

16. The heat pipe steam condenser according to claim 10, wherein the drain means comprises a downcomer having a plurality of drain openings through the at least one heat pipe vent condenser casing, a trap at a lower end of the downcomer, and a drain outlet at a side of the trap opposite the downcomer.

17. The heat pipe steam condenser according to claim 10, wherein the at least one heat pipe comprises a plurality of heat pipes encased by the at least one heat pipe vent condenser casing.

18. The heat pipe steam condenser according to claim 10, wherein the outlet of the at least one heat pipe vent condenser casing is connected to an eductor.

* * * * *